US011543109B2

(12) United States Patent
Mitchell, Jr. et al.

(10) Patent No.: US 11,543,109 B2
(45) Date of Patent: Jan. 3, 2023

(54) LIGHT FIXTURE WITH ROTATABLE LIGHT MODULES

(71) Applicant: ABL IP Holding LLC, Atlanta, GA (US)

(72) Inventors: Ricky M. Mitchell, Jr., Dallas, GA (US); LaDarius Agee, Lilburn, GA (US); Richard H. S. Bella, Snellville, GA (US); Paul W. Lewis, Jr., Grantville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/197,656

(22) Filed: Mar. 10, 2021

(65) Prior Publication Data

US 2022/0290849 A1 Sep. 15, 2022

(51) Int. Cl.

| | |
|---|---|
| ***F21V 23/00*** | (2015.01) |
| ***F21V 17/10*** | (2006.01) |
| ***F21V 31/00*** | (2006.01) |
| ***F21Y 115/10*** | (2016.01) |

(52) U.S. Cl.

CPC ..... *F21V 23/002* (2013.01); *F21V 17/107* (2013.01); *F21V 31/005* (2013.01); *F21Y 2115/10* (2016.08)

(58) Field of Classification Search

CPC ..... F21V 31/005; F21V 17/107; F21V 23/002
See application file for complete search history.

(56) References Cited

U.S. PATENT DOCUMENTS

| | | | | |
|---|---|---|---|---|
| 5,450,303 | A * | 9/1995 | Markiewicz | F16M 11/10 248/183.2 |
| 6,416,207 | B1 * | 7/2002 | Chang | F21V 21/26 362/418 |
| 8,072,123 | B1 * | 12/2011 | Han | F21K 9/23 313/45 |
| 9,732,951 | B2 * | 8/2017 | Guercio | F21S 2/005 |
| 9,897,296 | B1 * | 2/2018 | Baldwin | F21V 31/005 |
| 10,156,348 | B2 * | 12/2018 | Boorom | F21V 5/04 |
| 10,247,396 | B2 | 4/2019 | Johnson et al. | |
| 10,746,382 | B2 * | 8/2020 | Mullen | F21V 21/28 |
| 10,842,082 | B1 * | 11/2020 | Genga, Jr. | F21V 23/0471 |
| 11,274,817 | B2 * | 3/2022 | Wu | A01G 9/249 |
| 2020/0041109 | A1 | 2/2020 | Van Der Schyf et al. | |

* cited by examiner

*Primary Examiner* — Arman B Fallahkhair
(74) *Attorney, Agent, or Firm* — Kilpatrick Townsend & Stockton LLP

(57) ABSTRACT

An environmentally sealed light fixture for illuminating potentially hazardous environments. The sealed light fixture includes multiple light modules that are independently rotatable to customize the direction of light emitted from the fixture. The fixture is also modular and scalable, enabling additional light modules to be added to increase lumen output or area coverage. The sealed light fixture includes sealed light chambers, electronics chambers, and sealed connections between the modules for maintaining the integrity as well as concealing the wiring and electrical connections within the light fixture.

19 Claims, 6 Drawing Sheets

LIGHT FIXTURE WITH ROTATABLE LIGHT MODULES

BACKGROUND

Light fixtures such as area lights, particularly those used in outdoor applications or industrial environments, are exposed to harsh environmental conditions, including rain, dust, pollen, chemicals, temperature variations, ultraviolet light, and the like. In some indoor environments, the area lights can be exposed to dust and water. Exposure to such elements can degrade the light elements (such as light emitted diodes, "LEDs") and reduce the efficacy and light output of the area light over time. Traditionally, to protect the light elements a glass lens is added to the fixtures to keep harmful substances from entering the interior of the fixture. The glass diminishes the light output of the LEDs and even more so as it becomes scratched and/or discolored over time.

In addition, LEDs are typically mounted to a printed circuit board (PCB), with exposed electrical components that can be damaged or short-circuited by external elements, like mechanical objects or water. Moreover, wires are needed to supply power to the PCBs, and exposed wires are further susceptible to wear and tear over time. Wires also look unsightly, and the exposed surfaces of PCBs can be undesirable.

Moreover, many light fixtures designed for use in industrial or outdoor environments are formed with a single housing that houses both the light sources as well as the electrical components that power the light sources. In this way, the fixture is easier to seal and protect against the environmental elements and/or other harsh conditions. However, manufacturing limitations often limit the size that such fixtures can be. More specifically, it can be difficult to cast housings that are large enough to accommodate larger volumes of light sources and electronics desired and/or required for certain applications, such as illuminating parking lots and green spaces. Moreover, the electrical connections between the light sources and other electronics mounted to other parts of the housing require more exposed wire routing methods which require more complex assemblies for weatherproofing and aesthetic improvement to conceal aesthetically undesirable features required by the weatherproofing components.

Typical light fixtures rated for hazardous environments or rated for exposure to harsh environments are fixed and un-scalable. To the extent adjustable light fixtures have been provided, they typically are not adequately sealed against the environment to enable the use of such rotatable fixtures in harsh environments. There is a need for a light fixture that can be scaled up or down as desired to render it suitable for different applications all the while adequately protecting the fixture wiring and electronics for environmental conditions that can detrimentally impact operation of the light fixture.

BRIEF SUMMARY

Embodiments of the invention covered by this patent are defined by the claims below, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

One general aspect includes a sealed directable light fixture for high bay applications. The light fixture includes an electronics module enclosing electrical components for providing power to the light fixture. The light fixture also includes a first light module including a first light source and adapted to emit light emitted by the first light source. The light fixture also includes at least one first rotatable connector having a first connection portion coupled to the electrical housing and a second connection portion coupled to the first light module, where the first connection portion engages the second connection portion at a positionable rotatable joint operably coupling the first connection to the second connection. The at least one first rotatable connector enables rotational positioning of the first light module relative to the electronics module and. The at least one first rotatable connector defines a conduit through which wires pass from the electronics module to the first light module to connect the first light source to the electrical components.

Another general aspect includes a rotational joint for a sealed light fixture. The rotational joint includes a first connector portion having a first rotational joint portion at a first end of the first connector portion and a fixture connector at a second end for coupling to a first light fixture housing. The first connector portion defines a first conduit from the fixture connector to the first rotational joint portion. The rotational joint also includes a second connector portion having a second rotational joint portion at a first end of the second connector portion that rotationally couples with the first rotational joint portion and a fixture connector at a second end for coupling to a second light fixture housing. The second connector portion defines a second conduit from the fixture connector to the first rotational joint portion such that wires may pass from the first light fixture housing to the second light fixture housing through the first conduit and the second conduit.

Another general aspect includes a sealed directable light fixture. The sealed light fixture includes a first sealed light housing and a second sealed light housing. The sealed light fixture also includes a rotational joint coupling the first sealed light housing and the second sealed light housing. The rotational joint includes a first connector portion connected to the first sealed light housing at a first end of the first connector portion and has a first rotational joint portion at a second end of the first connector portion opposite the first end, the first connector portion also defining a first conduit from the first rotational joint portion to the first end. The rotational joint also includes a second connector portion connected to the second sealed light housing at a first end of the second connector portion and having a second rotational joint portion at a second end of the second connector portion opposite the first end, the second connector portion defining a second conduit from the second rotational joint portion to the first end and where the first rotational joint portion and the second rotational joint portion couple together to provide a releasable rotational joint to enable rotational positioning of the first sealed light housing and the second sealed light housing relative to one another.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among similar components. If only the first reference label is used in the specification, the description is applicable to any one of the similar components having the same first reference label irrespective of the second reference label.

DETAILED DESCRIPTION

Figure 1:
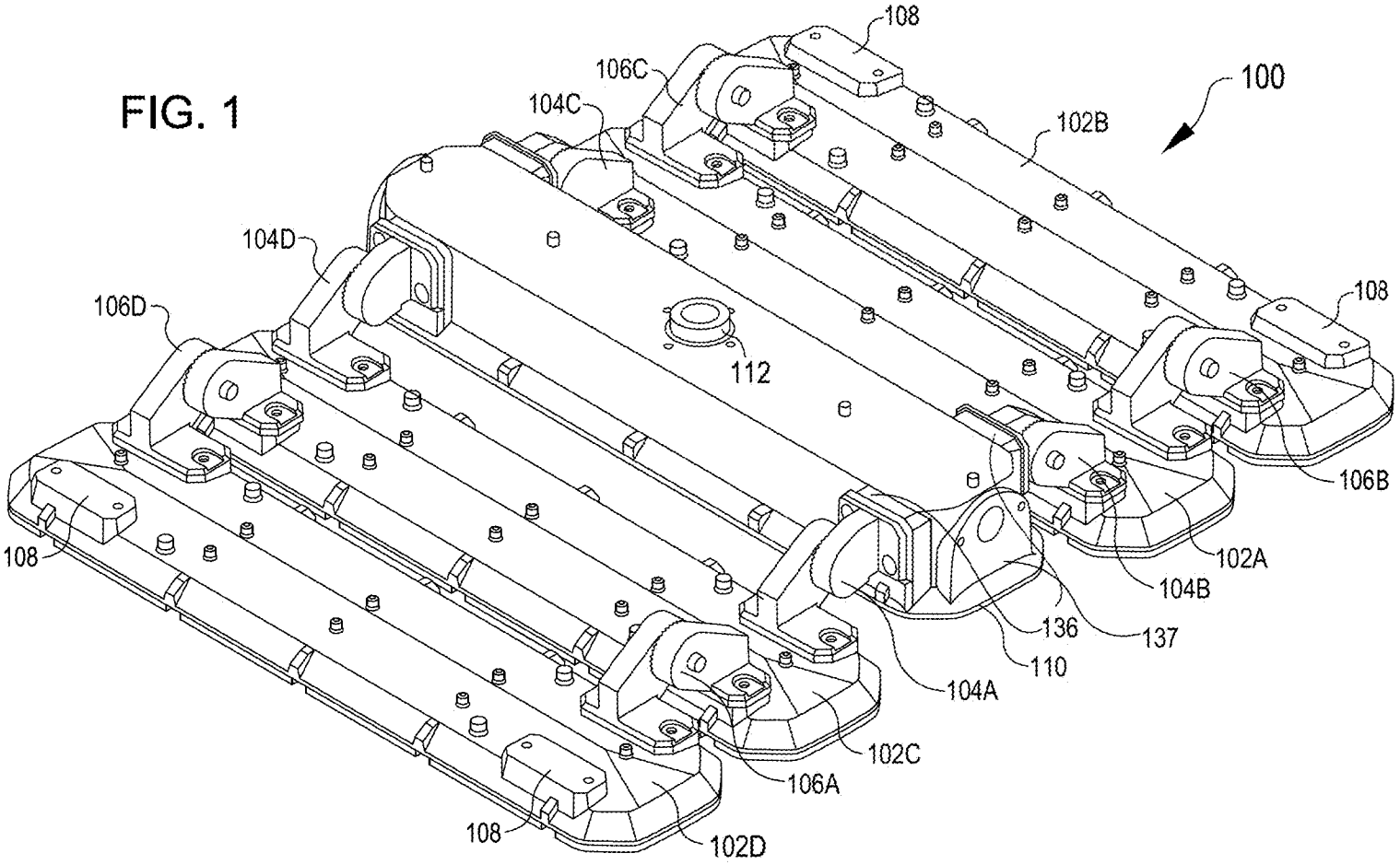
FIG. 1 illustrates a perspective view of a sealed light fixture having rotationally positionable light modules, according to some embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the interest of clarity, not all of the routine features of the examples described herein are shown and described. It will, of course, be appreciated that in the development of any such actual implementation, numerous implementation-specific decisions need to be made in order to achieve the developer's specific goals, such as compliance with application- and business-related constraints, and that these specific goals will vary from one implementation to another and from one developer to another.

Embodiments described herein include a light fixture rated for harsh and/or hazardous environments that include rotatable light modules for use in industrial applications. Additionally, the embodiments described herein are scalable and modular to enable light fixtures to be scaled and customized for particular industrial applications. Additional light modules may be added to the light fixture in a modular manner to achieve a higher lumen output. The rotatable light fixtures described herein may be rated for harsh and hazardous environments including industrial environments, petrochemical environments, manufacturing environments, and other such environments.

Embodiments of the present disclosure are directed to, among other things, a modular, rotatable light fixture for use in harsh environments. The modular rotatable light fixture includes at least two light modules and an electronics module interposed between the two light modules. In some examples, the light fixture may include multiple light modules positioned on one or both sides of the electronics module. In some examples, the electronics module may include light elements and the light modules may include light driver electronic components. Rotating connections between the modules enable individual direction and rotation of the modules relative to each other. The rotating connections also provide protection against ingress of environmental elements into the light fixture. In some aspects, the rotating connections also create an integral wireway channel that allows for light sources of the light modules to be connected with internal electronics of the electronics module and to connect additional light modules, enabling scaling of the size of the light fixture. In various cases, the integral wireway channel may improve ingress protection at the wire entry points into the electronics module and the light modules, thereby protecting the wires and electronics of the light fixture from the surrounding environment. The integral wireway channel may also eliminate or minimize undesirable aesthetics (e.g., exposed hardware or wiring) without requiring additional cosmetic components or parts to conceal the undesirable aesthetic features. Moreover, while individually the electronics module and the light module are of a size compatible with existing manufacturing methods, when assembled together they may form a light fixture of size that can accommodate larger volumes of light sources and electronics necessary than typical manufacturing techniques allow.

FIG. 1 illustrates a perspective view of a sealed light fixture 100 having rotationally positionable light modules 102, according to some embodiments. The sealed light fixture 100 includes four light modules 102A-D to provide illumination to an area underneath the light fixture, as illustrated in FIG. 1. In particular, the sealed light fixture 100 includes an electronics module 110 at the center of the four light modules 102A-D, the electronics module 110 including driver electronics and electrically coupled to light emitting devices in each of the light modules 102. Driver electronics and wiring have been omitted from the figures for clarity of illustration, but it is to be understood that they are present as needed. A number of light sources, such as light emitting diodes (LEDs), are positioned within the light modules 102. Though the embodiments described herein may be described with reference to LEDs or other particular light sources, other light sources including incandescent, fluorescent, halogen, and any other suitable light source may be used in place of, or in addition to, the LEDs.

In the illustrated embodiment, the sealed light fixture 100 is arranged with the electronics module 110 in the center of the arrangement with two light modules 102 on each side of the electronics module 110. The light modules 102A and 102C immediately adjacent the electronics module 110 are coupled to the electronics housing via the rotating joints 104A-D. The light modules 102B and 102D are coupled to the light modules 102A and 102C through rotating joints 106A-D. The rotating joints 104A-D and 106A-D are shown and described in greater detail with respect to FIGS. 5-9 below. The rotating joints 104A-D and rotating joints 106A-D provide for electrical connections between the electronics module 110 and the light modules 102A and 102C as well as between adjacent light modules in a manner that maintains the sealed environment within the sealed light fixture 100. In addition, the rotating joints 104A-D and 106A-D provide covered conduits for the electrical connections, improving the visual appearance of the sealed light fixture 100 by eliminating exposed wiring as well as increasing longevity and protection against the surrounding environment by shielding the wiring from any harsh environmental conditions. In some environments, particularly environments where flammable materials may be present, such as petrochemical production environments, reducing potential electrical exposure provides additional safeguards against any incidental sparks from exposed wiring.

The rotating joints 104A-D and 106A-D allow for individual rotational positioning of the light modules 102 relative to the electronics module 110 as well as each other. Each rotating joint 104A-D and 106A-D provides rotation about a single axis, such that each light module 102 may rotate about its length. As shown and described with respect to FIGS. 2-4, the rotating joints 104, 106 enable numerous configurations of the sealed light fixture 100 providing directed light in numerous directions with different embodiments positioned at different angles.

Figure 11:
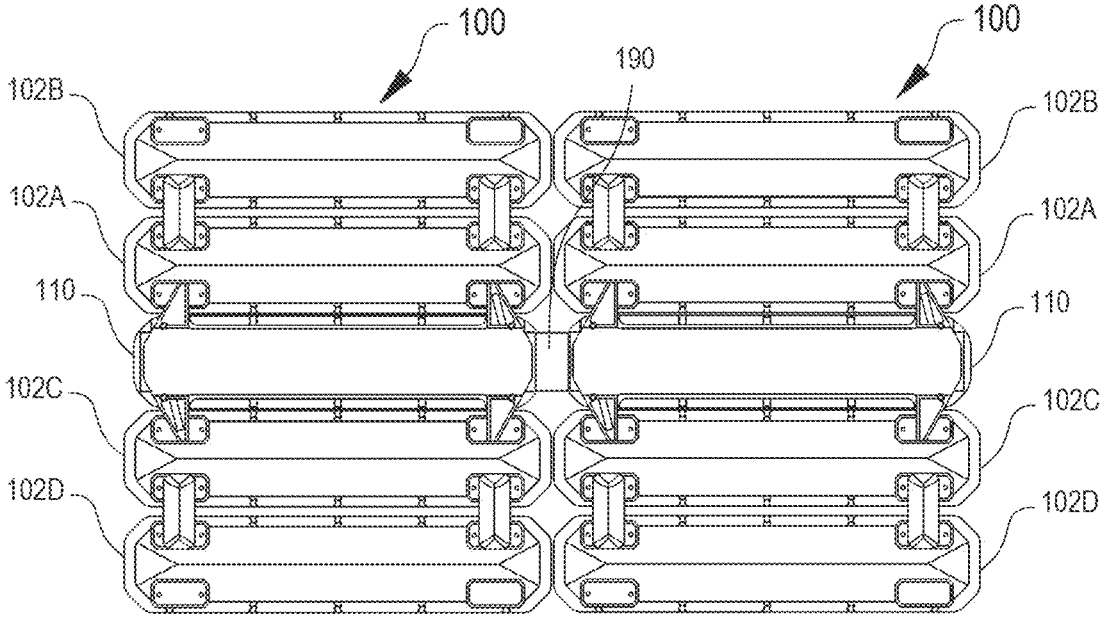
FIG. 11 illustrates a top plan view of two light fixtures connected, according to some embodiments.

The sealed light fixture 100 is shown with four light modules 102 and one electronics module 110. The sealed light fixture 100 enables expansion and scaling of different numbers of electronics modules 110 and light modules 102 for particular needs and environments. The light modules 102 include fixture locations 108 where additional rotating joints 104 and 106 may connect to provide connections to additional light modules and electronics enclosures. This expandability enables the sealed light fixture to be scaled to any number of light modules 102 connected to one another with rotating joints 106. As shown, additional light modules 102 may be connected to the existing light modules 102A-D to provide additional parallel light modules. Additionally, electronics module 110 includes end connection points 137 and side mounting locations 136 for connecting further electronics module 110 and/or light modules 102, for example to expand in a second direction, enabling the sealed light fixture 100 to expand in both an X and a Y direction to create a light fixture of any suitable dimensions to provide additional lumens to light an area. An example of the sealed light fixture 100 attached to a second sealed light fixture is shown in FIG. 11.

The sealed light fixture 100 is entirely sealed against the surrounding environment when installed such that the interior of the light modules 102 and the electronics module 110 are all sealed against ingress of foreign matter from the surrounding environment. In particular, the electronics module 110 receives power and electronics control wiring through port 112, which is sealed around such wiring. The electronics module 110 may include circuit boards, drivers, ballasts, or other electrical components for operation of the sealed light fixture 100. The electronics module 110 may also include light elements, directed upwards for uplighting or downwards towards a floor or surface beneath the sealed light fixture 100.

The light modules 102 include components shown in the exploded view of FIG. 10 described below and generally include a light module housing, light emitting device, a lens, a lens holder, and a gasket to seal around the lens opening. The light modules 102 include light elements directed or reflected downwards as shown in FIG. 1, though additional upward lighting may be incorporated in some embodiments. The light modules 102 may include reflectors, printed circuit boards, heat dissipation elements such as heat sinks and cooling fins, and other such components typically associated with light fixtures.

Figure 2:
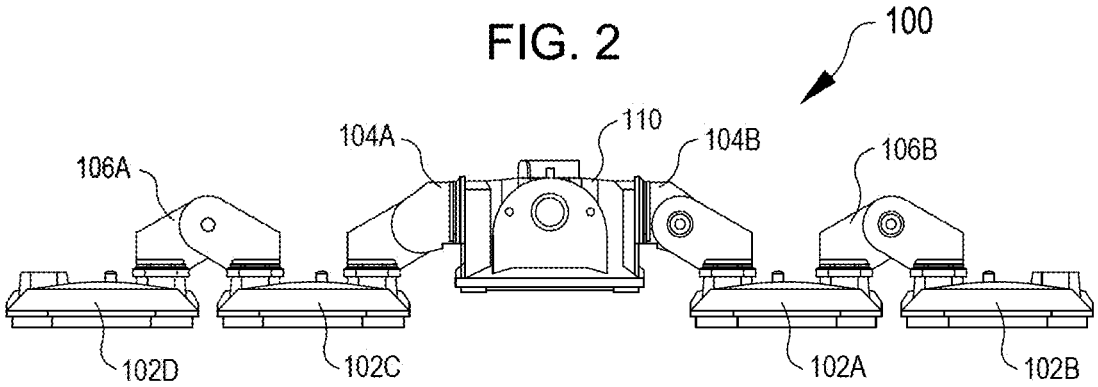
FIG. 2 shows an end view of the sealed light fixture of FIG. 1 with the light modules aligned along a single plane, according to some embodiments.

FIG. 2 shows a side view of the sealed light fixture 100 of FIG. 1 with the light modules 102 aligned along a single plane, according to some embodiments. As described above, the rotating joints 104 and 106 may be rotated and locked in position to enable different rotational positions of the light modules 102 and the electronics module 110 with respect to one another. As shown in FIG. 2, the light modules 102 and the electronics module 110 are all shown with a bottommost surface parallel to one another. In some examples, such a configuration may provide an even distribution of light across a uniform area underneath the sealed light fixture 100. The sealed light fixture 100 may be suspended from a ceiling by attaching the electronics module 110 to a suspended cable or directly mounting it to the ceiling or other structure above the area to be illuminated. In some examples, the sealed light fixture 100 may be connected to any other structure or surface, for example on a wall or post to provide directional light at an area of interest.

Figure 3:
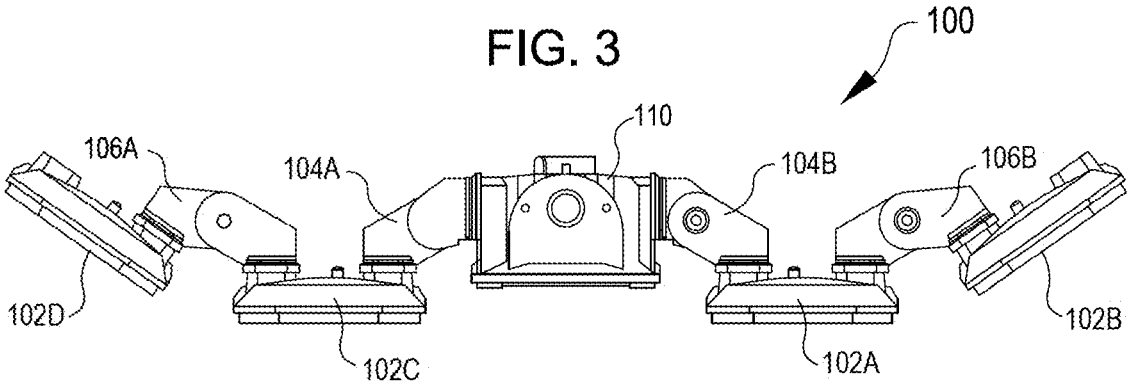
FIG. 3 shows an end view of the sealed light fixture of FIG. 1 with the outermost light modules rotated, according to some embodiments.

FIG. 3 shows a side view of the sealed light fixture 100 of FIG. 1 with the outermost light modules 102B and 102D rotated upwardly, according to some embodiments. The rotating joints 106A and 106B are shown enabling positioning of the light modules 102B and 102D and maintaining the rotational position of the light modules 102B and 102D after setting the angle. The light modules 102B and 102D may be directed outwards to provide a wider field of coverage of light from the sealed light fixture 100 than would be possible from a non-rotatable light fixture. In some embodiments, the light modules 102B and 102D may be directed at particular areas of interest to provide more direct illumination, for example of particular equipment in a manufacturing facility.

Though only a single angle is shown for rotating joints 106 and 104, as described below with respect to FIGS. 5-9, the rotating joints 104 and 106 enable positioning at a variety of angles, and may provide adjustability for the light modules of up to 270 degrees or more in some embodiments. In some examples, the full range of motion for adjustment of the rotational position of the light modules may be up to 270 degrees, with rotation up to 180 degrees in a first, clockwise, direction and up to 90 degrees in a second, counterclockwise, direction.

Figure 4:
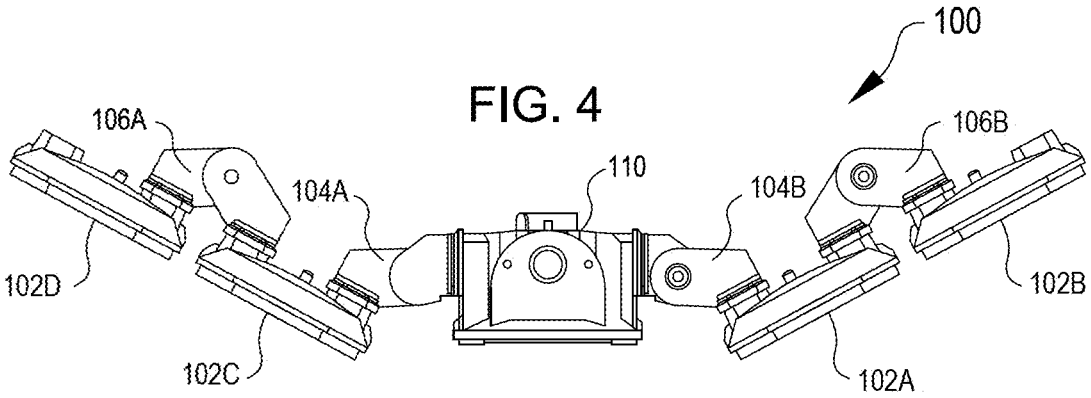
FIG. 4 shows an end view of the sealed light fixture of FIG. 1 with the light modules angled outwardly, according to some embodiments.

FIG. 4 shows a side view of the sealed light fixture 100 of FIG. 1 with the light modules 102 angled outward away from the center, according to some embodiments. As shown, the rotating joints 106 are positioned at approximately the same angle pictured above with respect to FIGS. 1 and 2, but the rotating joints 104 are shown with a different angle, resulting in light modules 102A-D being directed at a first angle with respect to the electronics module 110. In some examples, the light modules 102A-D may each be positioned at different angles with respect to the electronics module 110 by adjusting the positioning of the rotating joints 104 and 106. The positioning and angles of the rotating joints 104 and 106 may be adjustable over a wide range of angles. In addition, though FIGS. 3 and 4 each display only a change in one of rotating joints 104 or 106 as compared to FIG. 2, rotating joints 104 and 106 may be simultaneously positioned at any possible angle, enabling a high degree of customizability for the light coverage from the sealed light fixture 100.

Figure 5:
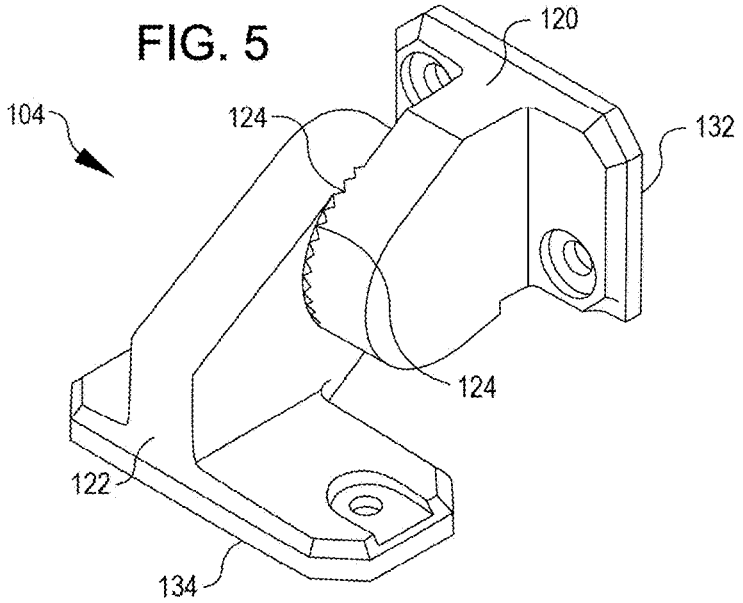
FIG. 5 shows a perspective view of a rotating joint for use between the light modules and the electronics module of the sealed light fixture of FIG. 1, according to some embodiments.

FIG. 5 shows a perspective view of a rotating joint 104 for use between light modules 102 and electronics module 110 of the sealed light fixture of FIG. 1, according to some embodiments. The rotating joint 104 includes a first connector portion 120 and a second connector portion 122. The first connector portion 120 and the second connector portion 122 join together at a rotational engagement 124. The rotational engagement 124 provides for the first connector portion 120 and the second connector portion 122 to be positioned at varying angles relative to one another. The rotational engagement 124 has a first joint interface on the first connector portion 120 and a second joint interface on the second connector portion 122.

The first connector portion 120 includes a fixture connection 132 to connect, either permanently or releasably, to the electronics module 110 at side mounting locations 136. The second connector portion 122 likewise includes a fixture connection 134 to connect, either permanently or releasably, to a light module 102. The fixture connections 132 and 134 may be affixed with screws, adhesives, welding, rivets, or other such attachment mechanisms. The fixture connections 134 and 134 may also include a gasket or other seal to seal the connection between the fixture connection 134 and the electronics module 110 or the light module 102 to ensure the sealed light fixture 100 is entirely sealed against the environment.

The rotational engagement 124 is pictured as including a plurality of interlocking teeth on each of the first connector portion 120 and the second connector portion 122 that interlock to maintain a set angular position relative to one another when the rotational engagement 124 is secured. In some embodiments, the rotational engagement 124 is secured through the use of a threaded connection, including a screw through the first connector portion 120 or the second connector portion 122 to secure the two together securely and engage the interlocking teeth of the rotational engagement, as shown and discussed in more detail with respect to FIGS. 8 and 9. In such embodiments, repositioning the angle of the rotational engagement 124 involves loosening the threaded connection until the interlocking teeth are capable of rotating relative to one another without interfering with one another and then retightening the threaded connection when the desired angle is set to secure the interlocking teeth together and maintain the desired angle at the rotational engagement 124.

In some embodiments, the rotational engagement 124 may be secured through the use of a spring element, such as a tension spring that provides tension to maintain the first connector portion 120 and the second connector portion 122 in contact. The spring element may bias the teeth into contact with one another. In some embodiments, an external spring may provide a compressive force to maintain the rotational engagement 124 in contact. For example, a pin may traverse the rotational engagement 124 from the first connector portion 120 and protrude through the second connector portion 122. On the exterior of the second connector portion 122, a captured spring on the pin may provide a compressive force to maintain the rotational engagement 124 in contact. For adjusting the rotational engagement in such embodiments, the spring may be compressed with a greater force to disengage the rotational engagement 124 and set the desired angle.

In some embodiments, the rotational engagement 124 may incorporate friction enhancing elements to alone maintain, or assist in maintaining, the position of the respective components of the rotational joint 104. For example, the rotational engagement 124 may not include the interlocking teeth but may instead include a frictional surface, such as provided by a rubber gasket, such that when the rotational engagement 124 is tightened through the threaded connection or other means the friction of the rubber gasket resists rotation of the rotational joint 104. Alternatively, a frictional element may be provided on the interlocking teeth of the rotational engagement 124.

The rotational joint 104 may be constructed from various suitable materials as desired. In some cases, rotational joint 104 may be constructed from any metallic or polymeric material having suitable rigidity and suitable thermal management properties so as to effectively dissipate heat generated by the components of the sealed light fixture 100. As a non-limiting example, in some embodiments the rotational joint 104 may be constructed from metal, such as aluminum or steel. In some embodiments, the rotational joint 104 is formed of cast aluminum.

Figure 6:
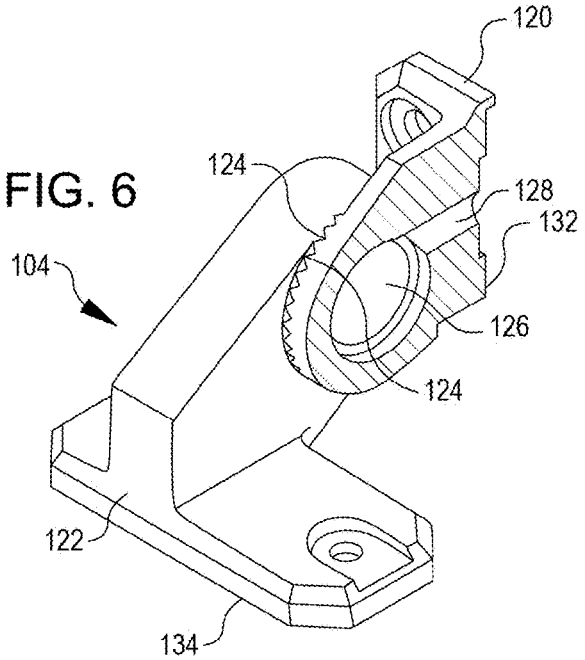
FIG. 6 shows a partial section view of the rotating joint of FIG. 5, according to some embodiments.
Figure 7:
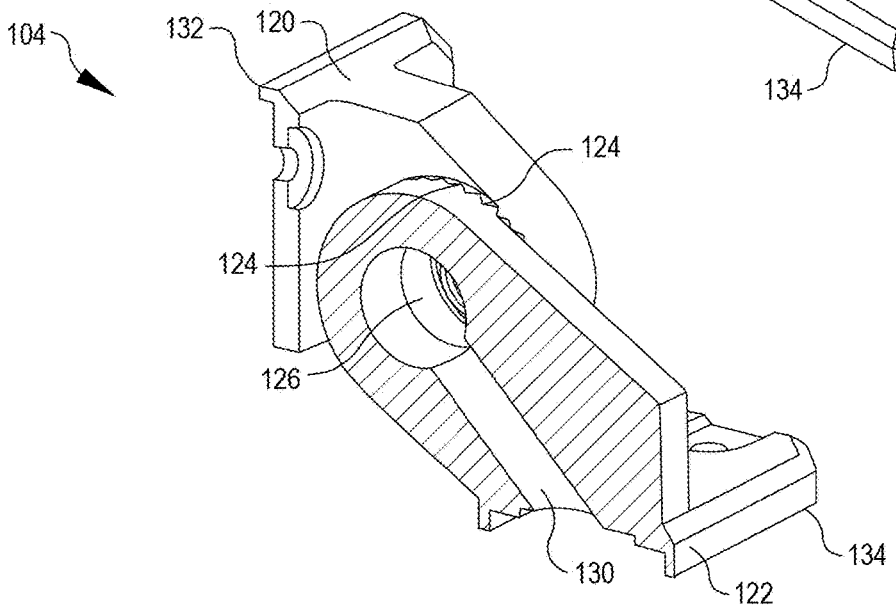
FIG. 7 shows a partial section view of the rotating joint of FIG. 5, according to some embodiments.

FIGS. 6 and 7 show section views of the rotating joint 104 of FIG. 5, according to some embodiments. The section view of FIG. 6 is taken through the first connector portion 120. The first connector portion 120 defines a conduit 128 from the fixture connection 132 to the rotational engagement 124, the conduit 128 providing a wireway or path from the electronics module 110 through which electrical wires may be routed to maintain the wiring within the sealed environment of the sealed light fixture 100 to provide the benefits described herein, including protection against potentially harsh environments as well as aesthetic benefits. The conduit 128 connects to a passageway 126 that traverses the rotational engagement 124 to a conduit 130 in the second connector portion 122. The passageway 126 may be surrounded by a gasket or seal that is incorporated with the rotational engagement 124 to seal the passageway 126 when assembled together. The section view of FIG. 7 provides a view of the passageway 126 traversing the rotational engagement 124 and connecting to the conduit 130 to provide a passageway through the body of the rotational joint 104.

Figure 8:
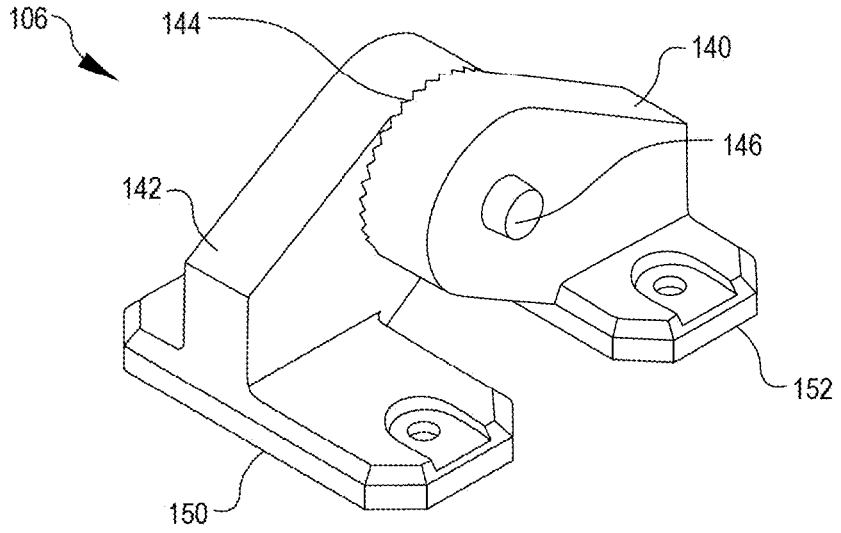
FIG. 8 shows a perspective view of a rotating joint for use between adjacent light modules of the light fixture of FIG. 1, according to some embodiments.

FIG. 8 shows a perspective view of a rotating joint 106 to connect adjacent light modules 102 of the sealed light fixture 100 of FIG. 1, according to some embodiments. The rotating joint 106 may be similar, or in some embodiments identical, to the rotating joint 104 described above. The rotating joint 106 includes a rotational engagement 144 similar to the rotational engagement 124, fixture connections 150 and 152, and first and second connector portions 140, 142. The fixture connections 150 and 152 provide connections to adjacent light modules 102 in a manner similar to the fixture connections 132 and 134. The rotating joint 106 includes a threaded element 146 that may be tightened to secure the rotating joint 106 in position by interlocking the teeth of the rotational engagement 144 and relying on interference between the surface and/or friction at the rotational engagement 144 to maintain the angle of the first connector portion 140 and the second connector portion 142.

Figure 9:
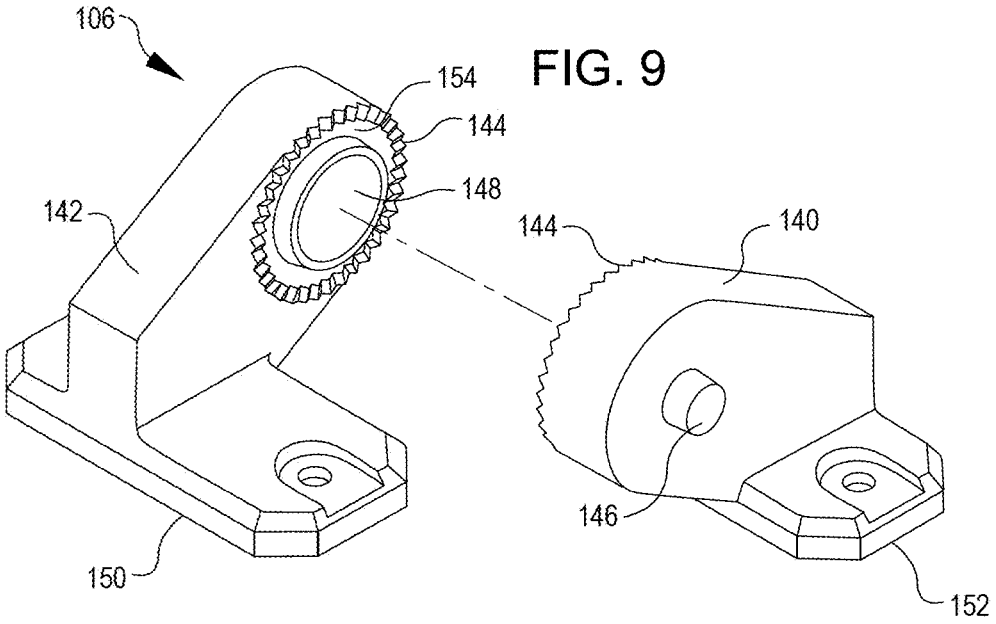
FIG. 9 shows an exploded view of the rotating joint of FIG. 8, according to some embodiments.

FIG. 9 shows an exploded view of the rotating joint 106 of FIG. 8, according to some embodiments. The exploded view shows the first connector portion 140 separated from the second connector portion 142 at the rotational engagement 144. The interlocking teeth are visible as well as a passageway 148 through the rotational joint 106, similar to the passageway and conduit described with respect to rotational joint 104 to provide a passage for electrical connections through the rotational joint 106. Similar interlocking teeth and passageways may be included in first and second connector portions 140, 142. A recess 154 for a gasket or seal is also illustrated such that the passageway 148 may be sealed against the surrounding environment as well as to provide a frictional engagement at the rotational engagement 144.

In some embodiments, the rotating joints 104 and 106 allow the light modules 102 to be angled upwardly or downwardly relative to the electronics module 110 and/or each other. In this way, the directionality of the light emitted from the light fixture 100 can be controlled. While the light modules 102 are illustrated and described as being rotatable relative to the electronics module 110 and each other, it should be noted that not all light modules 102 must be rotatable within the light fixture 100. By way only of illustration, in some embodiments the light modules 102 directly adjacent the electronics module 110 could be fixedly attached to the electronics module 110 but other of the adjacent light modules 102 could be rotatably connected to each other. Moreover, while the light fixture 100 may be symmetrical in that the same number of light modules 102 are provided on each side of the electronics module 110, such is not a requirement.

Figure 10:
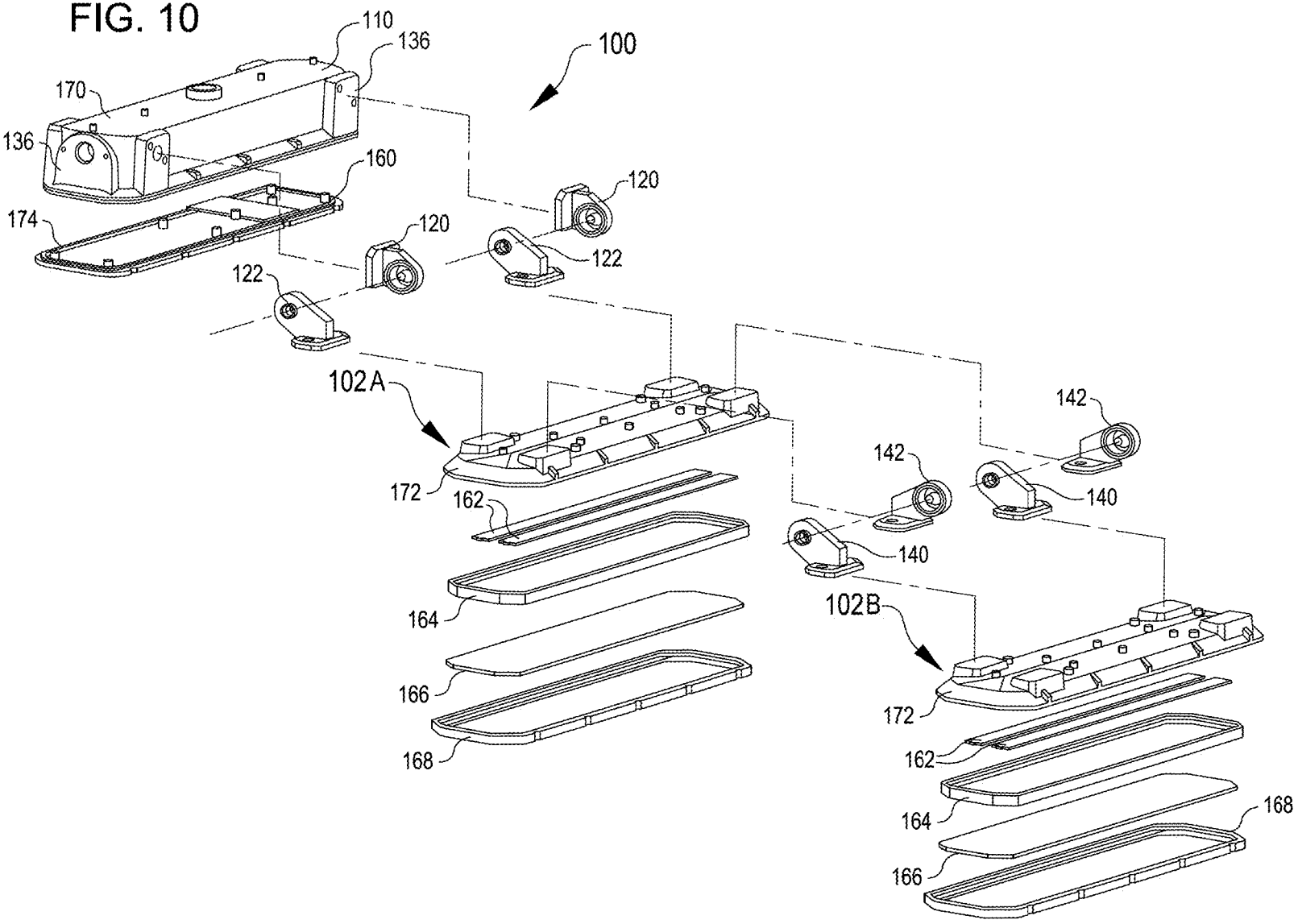
FIG. 10 illustrates an exploded view of part of the light fixture of FIG. 1, according to some embodiments.

FIG. 10 illustrates an exploded view of one side of the sealed light fixture 100 of FIG. 1. More specifically, FIG. 10. Illustrates an exploded view of electronics module 110, light modules 102A and 102B (see FIG. 1), and rotational joints 104, 106 that connect the illustrated modules together. Additional light modules 102 may be added using rotating joints 104, 106, though only two are shown for simplicity as additional components will be similar or identical to those illustrated in FIG. 10.

As shown in FIG. 10, the electronics module 110 includes an electronics housing 170 and a cover 160. Various electronics (not illustrated) including, but not limited to, a driver, battery pack(s), controllers, wireless communication modules, and/or other suitable components as desired may be housed within the electronics housing 170. Optionally, the electronics housing 170 may include one or more side mounting locations 136 on which first connector portion 120 of the rotating joints 104 may connect. In some embodiments, a port 112 is provided in the electronics housing 170 through which input power lines and/or other wiring may extend to connect to one or more power sources (e.g., drivers) and/or other electronics within the electronics module 110 for powering and controlling the light modules 102. As a non-limiting example, drivers within the electronics module 110 may convert line voltage, for example 110 volt or 220 volt alternating current (AC) power, to a lower voltage direct current (DC) power suitable for driving light sources such as LEDs.

The cover 160 may be removably secured over the electronics housing 170 to selectively enclose the electronic housing 170. The cover 160 may be removably secured to the electronics housing 170 via various suitable mechanical or chemical mechanisms as desired. In the example of FIG. 10, fasteners secure the cover 160 to the electronics housing 170 by selectively engaging engagement features such as bosses 174 or other suitable features. In some embodiments, the cover 160 may be hinged to the electronics housing 170 on one side so that the cover 160 can remain attached to the electronics housing 170 during servicing of the electronics within the electronics module 110. However, it will be appreciated that a hinged attachment is not required, and various other suitable securing mechanisms may be utilized as desired that keep the cover 160 attached during servicing and/or allow for the cover 160 to be completely detached from the electronics housing 101. Optionally, a gasket (not shown) may be provided at the interface between the electronics housing 170 and the cover 160 to at least partially seal the electronics housing 170 when the cover 160 is secured to the electronics housing 170. In some aspects, the seal provided by the gasket may be an airtight seal to minimize and/or prevent dust, water, and debris from entering the electronics module 110 and detrimentally impacting the electronics housed within.

The electronics housing 170 and cover 160 may be constructed from various suitable materials as desired. In some cases, the electronics housing 170 and/or the cover 160 may be constructed from any metallic or polymeric material having suitable rigidity and suitable thermal management properties so as to effectively dissipate heat generated by the electronics housed within the electronics module 110. As a non-limiting example, in some embodiments the electronics housing 170 and a cover 160 are constructed from metal, such as aluminum or steel. In some embodiments, the electronics housing 170 and/or cover 160 is formed of cast aluminum.

Each light module 102 includes a light module housing 172, light elements 162 (illustrated as LED strips), a gasket 164, a lens 166, and a frame 168. Second connector portions 122 of rotating joints 104 are mounted on the light module housing 172 of light module 102A for engagement with the first connector portions 120 mounted on the electronics module 110. One of first or second connector portions 140, 142 of rotating joint 106 are respectively mounted on each light module housing 172 of light module 102A, 102B to rotatably connect lights modules 102A, 102B. Note that while two rotating joints are illustrated for connecting the electronics module 110 and light modules 102, fewer or more joints may be used.

The light module housing 172 and/or frame 168 may be constructed from various materials similar to those described above with respect to the electronics module 110. The gasket 164 may be rubber or any other suitable material to provide a seal against the environment around the light module housing 172. The frame 168 may be formed of the same or a different material as the light module housing 172 but is generally formed of a material that may be rigid to apply pressure against the lens 166 and gasket 164 to seal the light module 102. The lens 166 may include multiple layers, such as a prismatic lens, a transparent glass lens, and other such layers to diffuse and distribute light from the light elements 162. Additional electronic components, such as wiring connecting the electronics module 110 to the light elements 162 are not illustrated but are also intended.

The gasket 164, as well as other gaskets and seals shown and described herein may provide for sealing the environment of the sealed light fixture and may also provide for vibration dampening, for example to protect electronic, glass, and other components from vibrations in industrial environments that may otherwise rattle and damage such components. For example, gaskets may be included between the first connector portion 120 and the second connector portion 122 and between the first and second connector portions 140, 142

FIG. 11 illustrates a top plan view of two sealed light fixtures 100 as described herein connected via a connector 190 positioned at the end connection points 137 of electronics modules 110, according to some embodiments. As described previously, the sealed light fixtures may expand, with additional light modules 102 in a first direction, vertically in FIG. 11. Additional expansion is enabled by connecting multiple light fixtures 100 together. In some examples the light fixtures 100 are connected by the connector 190 that may implement releasable connections such as threaded connections and the like to couple the sealed light fixtures together. The light fixtures 100 may thereby enable creation of an array of light modules 102 to cover a desired area and provide a desired amount of light to a particular region. While the present subject matter has been described in detail with respect to specific aspects thereof, it will be appreciated that those skilled in the art, upon attaining an understanding of the foregoing, may readily produce alterations to, variations of, and equivalents to such aspects. Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter. Accordingly, the present disclosure has been presented for purposes of example rather than limitation, and does not preclude the inclusion of such modifications, variations, and/or additions to the present subject matter as would be readily apparent to one of ordinary skill in the art. It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A light fixture comprising:

an electronics module enclosing electrical components for providing power to the light fixture;

a first light module comprising a first light source and adapted to emit light generated by the first light source from a bottom side of the first light module;

a second light module comprising a second light source and adapted to emit light generated by the second light source from a bottom side of the second light module;

a first rotatable connector comprising a first connector portion having a first fixture connection and a second connector portion having a second fixture connection, wherein the first fixture connection of the first connector portion of the first rotatable connector is coupled to the electronics module and the second fixture connection of the second connector portion of the first rotatable connector is coupled to a top side of the first light module opposite the bottom side of the first light module, wherein the first connector portion and the second connector portion of the first rotatable connector are rotatably connected such that an axis of rotation between the first connector portion and the second connector portion of the first rotatable connector extends at a location that is vertically offset above the top side of the first light module and such that the first light module is rotatably coupled with the electronics module, the first rotatable connector enabling rotational positioning of the first light module relative to the electronics module and also defining a conduit through which wires pass from the electronics module to the first light module to connect the first light source to the electrical components; and a second rotatable connector comprising a first connector portion having a first fixture connection and a second connector portion having a second fixture connection, wherein the first fixture connection of the first connector portion of the second rotatable connector is coupled to the top side of the first light module and the second fixture connection of the second connector portion of the second rotatable connector is coupled to a top side of the second light module opposite the bottom side of the second light module, wherein the first connector portion and the second connector portion of the second rotatable connector are rotatably connected such that an axis of rotation between the first connector portion and the second connector portion of the second rotatable connector extends at a location that is vertically offset above both the top side of the first light module and the top side of the second light module when the bottom sides of the first light module and the second light module are coplanar such that the first light module is rotatably coupled with the second light module and such that the first light module is interposed between the electronics module and the second light module, the second rotatable connector enabling rotational positioning of the second light module relative to the first light module.

2. The light fixture of claim 1, wherein the first rotatable connector comprises a plurality of interlocking teeth on the first connector portion of the first rotatable connector that engage with interlocking teeth on the second connector portion of the first rotatable connector.

3. The light fixture of claim 2, wherein the first rotatable connector comprises a seal between the first connector portion and the second connector portion to seal the conduit within the first rotatable connector.

4. The light fixture of claim 2, wherein the first rotatable connector comprises a threaded connection to releasably secure the first connector portion to the second connector portion.

5. The light fixture of claim 2, wherein the first rotatable connector comprises a spring element to bias the interlocking teeth on the first connector portion toward the interlocking teeth on the second connector portion.

6. The light fixture of claim 1, wherein the first light module and the electronics module each comprises a longitudinal axis, the longitudinal axis of the first light module and of the electronics module extend parallel to one another, and the first rotatable connector enables the first light module to rotate relative to the electronics module while the longitudinal axis of the first light module remains parallel to the longitudinal axis of the electronics module.

7. The light fixture of claim 1, wherein the second rotatable connector defines a conduit through which wires from the electronics module pass to the second light module to connect the second light source to the electrical components.

8. The light fixture of claim 1, wherein the first light module and the electronics module are each environmentally sealed to prevent ingress of material into the first light module, the electronics module, and the first rotatable connector.

9. A sealed light fixture, comprising:

an electronics module enclosing electrical components;

a first sealed light housing having a bottom side configured to emit light and a top side opposite the bottom side;

a second sealed light housing having a bottom side configured to emit light and a top side opposite the bottom side; and a first rotational joint adapted to couple the electronics module to the first sealed light housing along a first lateral side of the first sealed light housing and a second rotational joint adapted to couple the second sealed light housing to the first sealed light housing along a second lateral side of the first sealed light housing opposite the first lateral side such that the first sealed light housing is interposed between the electronics module and the second sealed light housing, each of the first and second rotational joints comprising: a first connector portion having a first housing interface and a second connector portion having a second housing interface, the first connector portion defining a first conduit extending from the first housing interface to a first joint interface, the second connector portion defining a second conduit extending from the second housing interface to a second joint interface, wherein the first connector portion of the first rotational joint is adapted to connect to the electronics module and the second connector portion of the first rotational joint is adapted to connect to the top side of the first sealed light housing, wherein the first connector portion and the second connector portion of the first rotational joint are rotatably connected such that an axis of rotation between the first connector portion and the second connector portion of the first rotational joint extends at a location that is vertically offset above the top side of the first sealed light housing, wherein the first connector portion of the second rotational joint is adapted to connect to the top side of the first sealed light housing and the second connector portion of the second rotational joint is adapted to connect to the top side of the second sealed light housing, wherein the first connector portion and the second connector portion of the second rotational joint are rotatably connected such that an axis of rotation between the first connector portion and the second connector portion of the second rotational joint extends at a location that is vertically offset above both the top side of the first sealed light housing and the top side of the second sealed light housing when the bottom sides of the first sealed light housing and the second sealed light housing are coplanar, and wherein the first joint interface and the second joint interface of each of the first and second rotational joints are adapted to engage to provide a releasable rotational joint to enable rotational positioning of the first sealed light housing relative to the electronics module and the second sealed light housing relative to the first sealed light housing.

10. The sealed light fixture of claim 9, wherein the first joint interface and the second joint interface of at least one of the first or second rotational joints comprise a plurality of interlocking teeth adapted to engage to rotationally lock the first connector portion and the second connector portion of the at least one of the first or second rotational joints.

11. The sealed light fixture of claim 10, wherein the first joint interface and the second joint interface of the at least one of the first or second rotational joints are releasably secured together with a threaded connection.

12. The sealed light fixture of claim 9, wherein at least one of the first or second rotational joints comprises a gasket to seal the first joint interface and the second joint interface to seal the first conduit or the second conduit against a surrounding environment.

13. The sealed light fixture of claim 9, wherein the first sealed light housing and the second sealed light housing are electrically coupled through the first conduit and the second conduit of the second rotational joint.

14. A light fixture comprising:

an electronics module;

a first sealed light housing having a first lateral side and a second lateral side opposite the first lateral side, and a bottom side configured to emit light and a top side opposite the bottom side;

a second sealed light housing having a bottom side configured to emit light and a top side opposite the bottom side;

a first rotatable connector adapted to couple the electronics module with the first sealed light housing, the first rotatable connector comprising a first portion adapted to connect to the electronics module and a second portion adapted to connect to the first sealed light housing such that the electronics module extend along the first lateral side of the first sealed light housing, the first and second portions of the first rotatable connector adapted to couple to define a sealed conduit from the electronics module to the first sealed light housing and to provide a releasable rotational joint to enable rotational positioning of the first sealed light housing relative to the electronics module; and a second rotatable connector adapted to couple the first sealed light housing with the second sealed light housing such that the second sealed light housing extends along the second lateral side of the first sealed light housing such that the first sealed light housing is interposed between the electronics module and the second sealed light housing, the second rotatable connector comprising a first portion connected to the first sealed light housing and a second portion connected to the second sealed light housing, the first and second portions of the second rotatable connector adapted to couple to define a sealed conduit from the first sealed light housing to the second sealed light housing and to provide a releasable rotation joint to enable rotational positioning of the second sealed light housing relative to the first sealed light housing, wherein the first portion of the first rotatable connector is coupled to the electronics module and the second portion of the first rotatable connector is coupled to the top side of the first sealed light housing such that an axis of rotation between the first portion and the second portion of the first rotatable connector extends at a location that is vertically offset above the top side of the first sealed light housing, and wherein the first portion of the second rotatable connector is coupled to the top side of the first sealed light housing and the second portion of the second rotatable connector is coupled to the top side of the second sealed light housing such that an axis of rotation between the first portion and the second portion extends at a location that is vertically offset above both the top side of the first sealed light housing and the top side of the second sealed light housing when the bottom sides of the first sealed light housing and the second sealed light housing are coplanar.

15. The light fixture of claim 14, wherein the first and second portions of the first rotatable connector or the first and second portions of the second rotatable connector are adapted to couple with a threaded connection.

16. The light fixture of claim 14, wherein the first rotatable connector or the second rotatable connector comprises a spring element to maintain connection of the respective first or second portions.

17. The light fixture of claim 14, wherein the first rotatable connector comprises a frictional connection between the first and second portions to help maintain the first sealed light housing in a fixed position with respect to the electronics module.

18. The light fixture of claim 14, wherein the first rotatable connector or the second rotatable connector comprises a gasket.

19. The light fixture of claim 14, wherein each of the first and second portions of the first and second rotatable connectors comprises interlocking teeth, the interlocking teeth configured to maintain a relative position of the first sealed light housing or the second sealed light housing.

* * * * *